US010543691B2

(12) United States Patent
Tanaka et al.

(10) Patent No.: US 10,543,691 B2
(45) Date of Patent: Jan. 28, 2020

(54) INKJET RECORDING APPARATUS

(71) Applicant: CANON KABUSHIKI KAISHA, Tokyo (JP)

(72) Inventors: Yusuke Tanaka, Kawasaki (JP); Hideaki Matsumura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/962,913

(22) Filed: Apr. 25, 2018

(65) Prior Publication Data

US 2018/0311964 A1 Nov. 1, 2018

(30) Foreign Application Priority Data

Apr. 27, 2017 (JP) ..... 2017-088488

(51) Int. Cl.
*B41J 2/175* (2006.01)
*B41J 29/13* (2006.01)
*B41J 29/02* (2006.01)

(52) U.S. Cl.
CPC ..... *B41J 2/17509* (2013.01); *B41J 2/175* (2013.01); *B41J 2/1752* (2013.01); *B41J 2/1754* (2013.01); *B41J 2/17536* (2013.01); *B41J 2/17553* (2013.01); *B41J 2/17596* (2013.01); *B41J 29/02* (2013.01); *B41J 29/13* (2013.01)

(58) Field of Classification Search
CPC ..... B41J 2/17509; B41J 2/175; B41J 2/1754; B41J 2/17596; B41J 2/17553; B41J 29/13; B41J 2/17536; B41J 2/1752; B41J 29/02
See application file for complete search history.

(56) References Cited

U.S. PATENT DOCUMENTS 5,711,453 A * 1/1998 Weiler ..... B65D 47/14 222/541.2
6,048,055 A * 4/2000 Hakkaku ..... B41J 2/175 347/85
7,537,141 B1 * 5/2009 Robinson ..... B65D 47/147 222/543
2009/0179964 A1 * 7/2009 Nakazawa ..... B41J 2/175 347/49
2013/0092713 A1 * 4/2013 Mabee ..... B65D 5/746 222/541.9

(Continued)

FOREIGN PATENT DOCUMENTS

JP 2003-127416 A 5/2003
JP 2015-150718 A 8/2015

(Continued)

*Primary Examiner* — Yaovi M Ameh
(74) *Attorney, Agent, or Firm* — Canon U.S.A., Inc. I.P. Division

(57) ABSTRACT

An inkjet recording apparatus includes a recording head configured to eject ink to record an image, an ink tank including an filling port for injection of the ink and configured to contain the ink to be supplied to the recording head, a cap configured to close the filling port, and a connection portion configured to connect the cap to the ink tank or a main body of the apparatus. The inkjet recording apparatus includes a rib provided adjacently to the filling port, the connection portion biases the cap in a direction separating from the filling port, and the cap removed from the filling port releases the filling port while being in contact with the rib by biasing of the connection portion.

9 Claims, 13 Drawing Sheets

(56) References Cited

U.S. PATENT DOCUMENTS

| | | | | |
|---|---|---|---|---|
| 2014/0225963 | A1* | 8/2014 | Ichihara | B41J 2/175<br>347/85 |

FOREIGN PATENT DOCUMENTS

| | | | | | |
|---|---|---|---|---|---|
| JP | 2016-132161 | A | | 7/2016 | |
| JP | 2016-132165 | A | | 7/2016 | |
| JP | 2016132165 | A | * | 7/2016 | B41J 2/175 |
| JP | 2016-165908 | A | | 9/2016 | |
| WO | 2016/199420 | A1 | | 12/2016 | |

* cited by examiner

INKJET RECORDING APPARATUS

BACKGROUND OF THE INVENTION

Field of the Invention

The present disclosure relates to an inkjet recording apparatus including a filling port through which ink is injected.

Description of the Related Art

A recording apparatus disclosed in Japanese Patent Application Laid-Open No. 2016-165908 includes an ink tank having a filling port for injection of ink, and a recording head that ejects the ink supplied from the ink tank. The filling port of the ink tank is opened or closed by a closure member. A user removes the closure member from the filling port, and injects the ink into the ink tank while the closure member is placed on a placing part.

In the apparatus disclosed in Japanese Patent Application Laid-Open No. 2016-165908, the user removes the closure member from the filling port and places the closure member on the placing part, and then injects the ink. It is necessary for the user to remove the closure member from the placing part to place the closure member back to the filling port after injection of the ink is completed. If the user attempts to inject the ink without placing the closure member on the placing part, the closure member may cover over the filling port, which may make it difficult to inject the ink.

SUMMARY OF THE INVENTION

The present disclosure is directed to an inkjet recording apparatus to which ink is easily injectable.

According to an aspect of the present disclosure, an inkjet recording apparatus includes a recording head configured to eject ink to record an image, an ink tank including a filling port for injection of the ink and configured to contain the ink to be supplied to the recording head, a cap configured to close the filling port, and a connection portion configured to connect the cap to the ink tank or a main body of the apparatus. The inkjet recording apparatus includes a rib provided adjacently to the filling port, the connection portion biases the cap in a direction separating from the filling port, and the cap removed from the filling port releases the filling port while being in contact with the rib by biasing of the connection portion.

Further features of the present disclosure will become apparent from the following description of exemplary embodiments with reference to the attached drawings.

DESCRIPTION OF THE EMBODIMENTS

Some exemplary embodiments of an inkjet recording apparatus according to the present disclosure will be described. Components described in the exemplary embodiments are merely illustrative and do not intend to limit the scope of the present disclosure. In the present specification, a serial inkjet recording apparatus in which a recording head ejecting ink to an intermittently conveyed recording medium, is reciprocated in a direction intersecting with a conveying direction of the recording medium, to perform recording, is described as an example. The present disclosure, however, is applicable to a line inkjet recording apparatus that uses an elongated printing head to continuously perform printing, without limitation to the serial inkjet recording apparatus. In the present specification, the term "ink" is used as a collective term of liquid such as recording liquid. Further, in the present specification, the term "recording" is not limited to recording with respect to a flat medium, and includes recording with respect to a three-dimensional object. In the present specification, the term "recording medium" is a medium receiving ejected liquid and is used as a collective term of recording media such as paper, fabric, a plastic film, a metal plate, glass, ceramics, wood, and leather. Moreover, the recording media include a rolled continuous sheet without limitation to a cut sheet.

Figure 1:
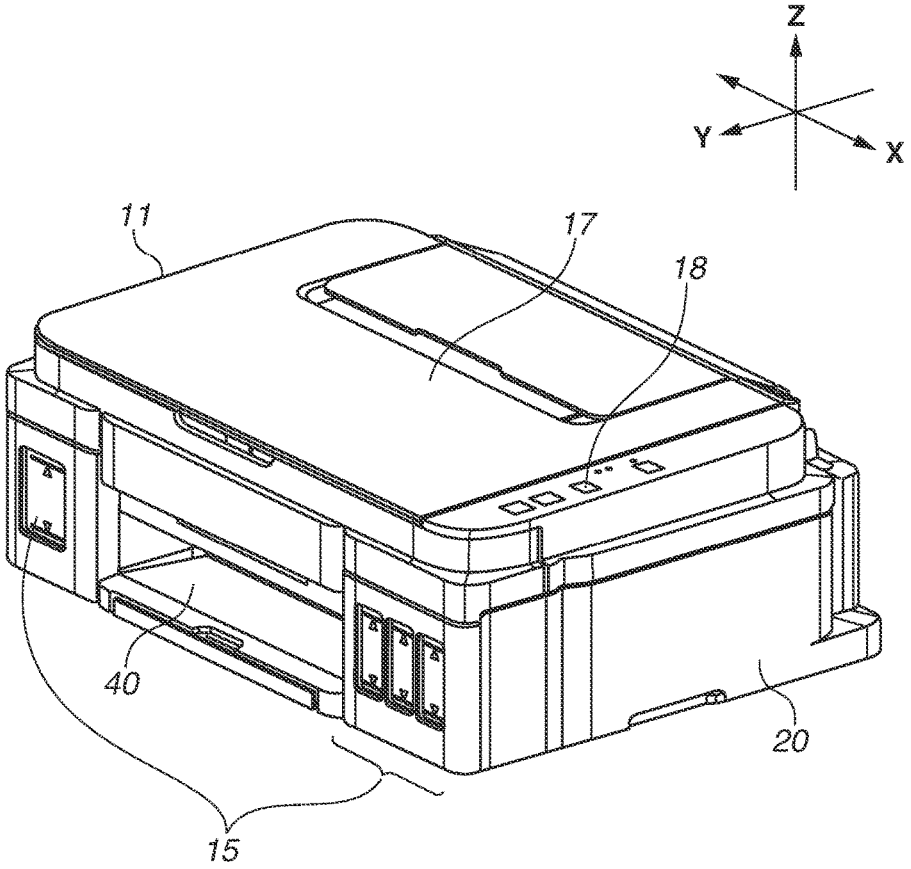
FIG. 1 is an external perspective view illustrating an inkjet recording apparatus according to a first exemplary embodiment.

A first exemplary embodiment of the present disclosure will be described in detail below with reference to drawings. FIG. 1 is an external perspective view illustrating an outline of an inkjet recording apparatus (hereinafter, recording apparatus) 11 in the first exemplary embodiment. As illustrated in FIG. 1, the recording apparatus 11 includes a housing (exterior part) 20, a recording head 13 (see FIG. 2) that performs recording operation on a recording medium (not illustrated), and an ink tank as an ink container that contains ink to be supplied to the recording head 13. In the first exemplary embodiment, the ink tank 15 is disposed on a front surface of the housing 20 and is fixed to a main body of the recording apparatus 11. Further, the recording apparatus 11 includes, on an upper part of the housing 20, a scanner unit 17 that performs reading operation of a document, and an operation input unit 18 through which the user performs operation such as instruction input.

Figure 2:
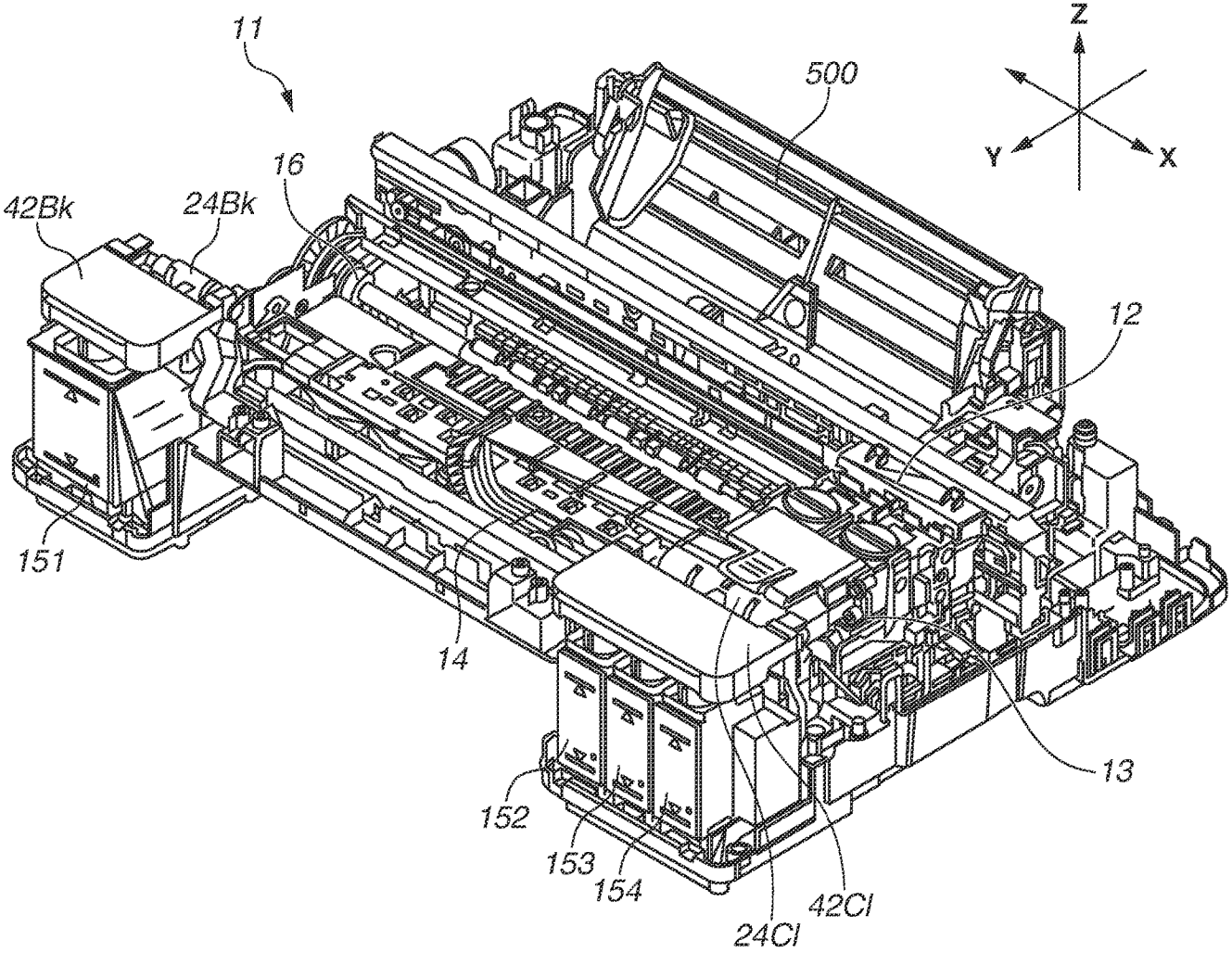
FIG. 2 is a schematic perspective view illustrating an internal configuration of the inkjet recording apparatus according to the first exemplary embodiment.

FIG. 2 is a perspective view illustrating an internal configuration of the recording apparatus 11. The recording apparatus 11 includes a feeding unit 500 that feeds the recording medium, a conveyance roller 16 that conveys the recording medium, and a discharging unit 40 (see FIG. 1) that discharges the recording medium. The recording medium is fed from the feeding unit 500 to the inside of the recording apparatus 11 by an unillustrated roller. Recording operation is performed on the fed recording medium by the recording head 13 while the recording medium is conveyed by the conveyance roller 16. The recording medium on which the recording has been completed is discharged from the discharging unit 40 to outside of the recording apparatus 11. A direction in which the recording medium is conveyed (Y direction illustrated in FIG. 2) is referred to as a conveyance direction.

A carriage 12 is moved, by an unillustrated driving source, along a main scanning direction (X direction) that intersects with the conveyance direction (Y direction) of the recording medium. In the first exemplary embodiment, the conveyance direction and the main scanning direction are orthogonal to each other. The recording head 13 is mounted on the carriage 12, and ejects ink droplets while being moved in the main scanning direction, thereby performing the recording operation to record an image for one band on the recording medium. When the image for one band is recorded on the recording medium, the recording medium is conveyed in the conveyance direction by a predetermined amount by the conveyance roller 16 (intermittent conveyance operation). The image is recorded on the entire recording medium through repetition of the recording operation for one band and the intermittent conveyance operation.

Further, the recording apparatus 11 includes a maintenance section in a movement region of the carriage 12 in the main scanning direction. The maintenance section includes a maintenance unit that performs maintenance processing of the recording head 13, and is disposed at a position so as to face an ink ejection port surface 31 (see FIG. 4) of the recording head 13. The maintenance unit includes, for example, a cap that can cover the ink ejection port surface 31, and a suction recovery mechanism. The suction recovery mechanism performs suction recovery operation to forcibly suck ink while the ink ejection port surface 31 is covered, to remove residual bubbles and thickened ink inside the ejection port. Ejection performance of the recording head 13 is maintained through the maintenance processing by the maintenance unit.

Figure 3:
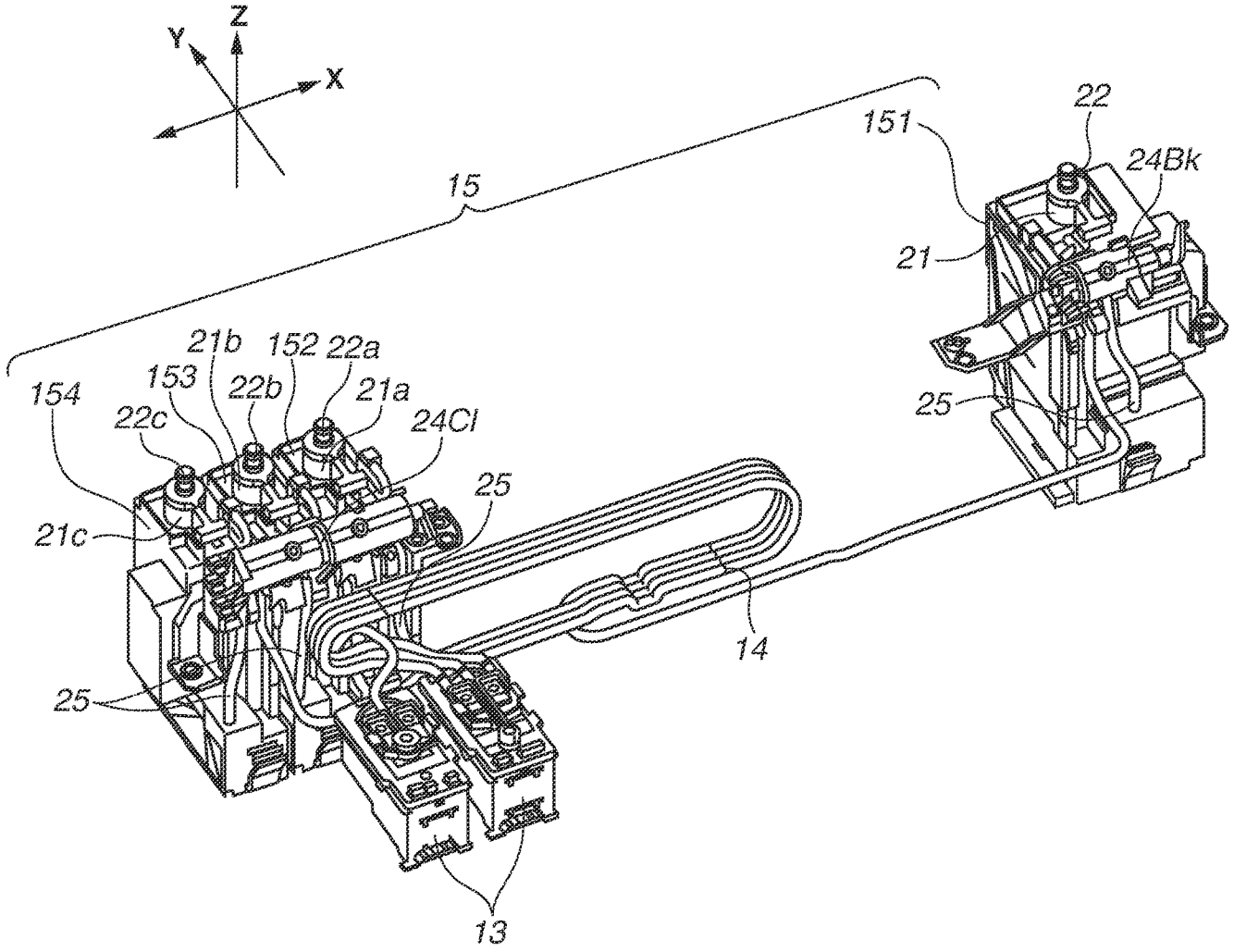
FIG. 3 is a schematic diagram illustrating an ink supply system of the inkjet recording apparatus according to the first exemplary embodiment.

FIG. 3 is a schematic diagram illustrating an ink supply system of the recording apparatus, and is a perspective view as viewed from rear side of the recording apparatus 11. The ink tank 15 is provided for each corresponding ink color. In the first exemplary embodiment, four ink tanks of a black ink tank 151, a cyan ink tank 152, a magenta ink tank 153, and a yellow ink tank 154 are provided, and are collectively referred to as the ink tank 15. As illustrate in FIG. 2, the black ink tank 151 is disposed on left side of the discharging unit 40 as viewed from front side of the recording apparatus 11. In contrast, the cyan ink tank 152, the magenta ink tank 153, and the yellow ink tank 154 are disposed on right side of the discharging unit 40 as viewed from the front side of the recording apparatus 11. In other words, the discharging unit 40 is provided between the black ink tank 151 and the color ink tanks.

A flexible tube that configures an ink supply path (ink flow path) 14 for supplying the ink to the recording head 13, is attached to the ink tank 15. Further, a flexible tube that configures an atmosphere communication path 25 communicating the inside of the ink tank 15 with the atmosphere is attached to the ink tank 15. A filling port 21 through which the user injects ink into the ink tank 15 is provided on an upper part of the ink tank 15. Moreover, a tank cap (hereinafter, cap) 22 that seals the filling port 21 is attached to the filling port 21. The user can inject the ink from the filling port 21 into the ink tank 15 by removing the cap 22. A detailed configuration of the vicinity of the cap 22 and the filling port 21 will be described later.

Figure 4:
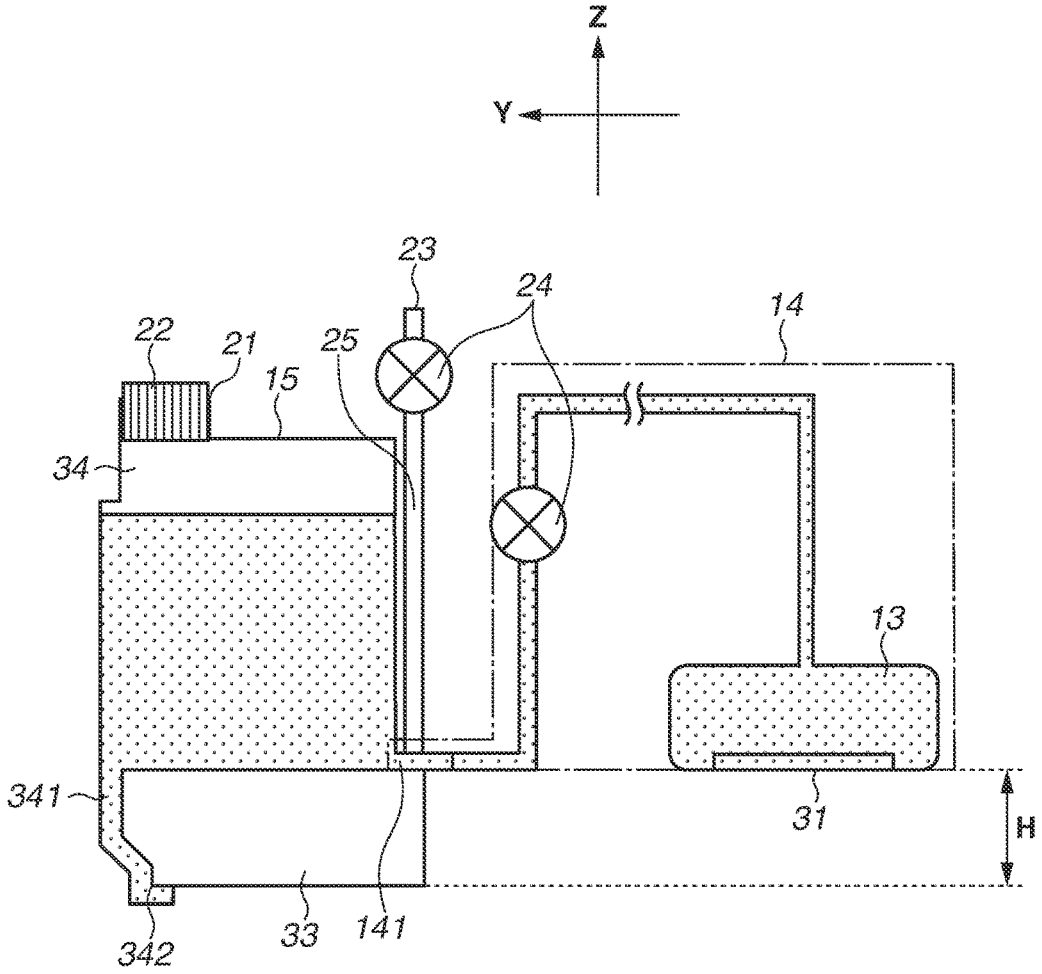
FIG. 4 is a schematic diagram illustrating the ink supply system of the inkjet recording apparatus according to the first exemplary embodiment.

FIG. 4 is a schematic diagram of the ink supply system illustrating positional relationship between the ink tank 15 and the recording head 13. A portion surrounded by an alternate long and short dash line indicates the ink supply path 14. An ink containing chamber 34 containing the ink is disposed at an upper part inside the ink tank 15, and an air containing chamber 33 containing air is disposed at a lower part inside the ink tank 15. The filling port communicates with the ink containing chamber 34. In addition, the cap 22 is attached to the filling port 21. The ink containing chamber 34 and the air containing chamber 33 are integrally provided inside the ink tank 15 such that a ceiling surface of the air containing chamber includes a part of a bottom surface of the ink containing chamber 34.

The ink containing chamber 34 and the air containing chamber 33 are connected to each other by a connection path 341 that configures a part of the ink containing chamber 34. The connection path 341 is disposed on downstream side in the conveyance direction in the ink tank 15. As illustrated in FIG. 4, the connection path 341 extends vertically downward from the ink containing chamber 34 and is connected to the air containing chamber 33 at a lowermost surface of the ink tank 15. In other words, a state where the ink is contained in the ink tank 15 indicates a state where the ink is contained in the ink containing chamber 34 and the connection path 341. The ink supply path 14 is connected to the upstream side of the ink tank 15 in the conveyance direction, through an ink flow port 141. Accordingly, the ink contained in the ink containing chamber 34 is supplied from the ink flow port 141 to the recording head 13 through the ink supply path 14.

An atmosphere communication port 23 that communicates with outside air is provided above the ink tank 15 on the upstream side in the conveyance direction. The air containing chamber 33 is connected to the atmosphere communication port 23 through the atmosphere communication path 25. When the valve unit 24 is open, the atmosphere communication path 25 is released and the air containing chamber 33 communicates with the atmosphere. In contrast, when the valve unit 24 is closed, the atmosphere communication path 25 is occluded and the air containing chamber 33 and the atmosphere do not communicate with each other. Since the air containing chamber 33 is also connected to the ink containing chamber 34, the ink containing chamber 34 also communicates with the atmosphere when the air containing chamber 33 communicates with the atmosphere. When the air containing chamber 33 does not communicate with the atmosphere, the ink containing chamber 34 also does not communicate with the atmosphere.

Further, the valve unit 24 of the first exemplary embodiment is able to open or close the ink supply path 14. In other words, when the valve unit 24 is open, the atmosphere communication path 25 and the ink supply path 14 are opened. When the valve unit 24 is closed, the atmosphere communication path 25 and the ink supply path 14 are occluded and blocked. Furthermore, as illustrated in FIG. 3, the valve unit 24 includes a black valve unit 24Bk and a color valve unit 24Cl. The black valve unit 24Bk opens or closes the ink supply path 14 and the atmosphere communication path 25 that are connected to the black ink tank 151. The color valve unit 24Cl integrally opens or closes the ink supply paths 14 and the atmosphere communication paths 25 that are respectively connected to the cyan ink tank 152, the magenta ink tank 153, and the yellow ink tank 154.

The ink tank 15 includes a gas-liquid exchange portion 342 between the connection path 341 and the air containing chamber 33 by the above-described configuration. This indicates that, along with the supply of the ink from the ink containing chamber 34 to the recording head 13, the air of the same amount as the supply amount of the ink is supplied from the air containing chamber 33 to the ink containing chamber 34 through the gas-liquid exchange portion 342. The gas-liquid exchange portion 342 is provided so as to be located lower by a height H than the ink ejection port surface 31 of the recording head 13. As a result, negative pressure caused by head difference of the height H is applied to the ink ejection port surface 31, which prevents the ink from being leaked from the ink ejection port surface 31. Further, an opening of the gas-liquid exchange portion 342 has a size sufficient to maintain meniscus of the ink.

In addition, the air containing chamber 33 serves as a buffer chamber that contains the ink pushed out of the ink containing chamber 34 when the air inside the ink containing chamber 34 is expanded due to air pressure variation, temperature variation, or other cause. This makes it possible to suppress leakage of the ink from the atmosphere communication port 23 through the atmosphere communication path 25.

Figure 5A:
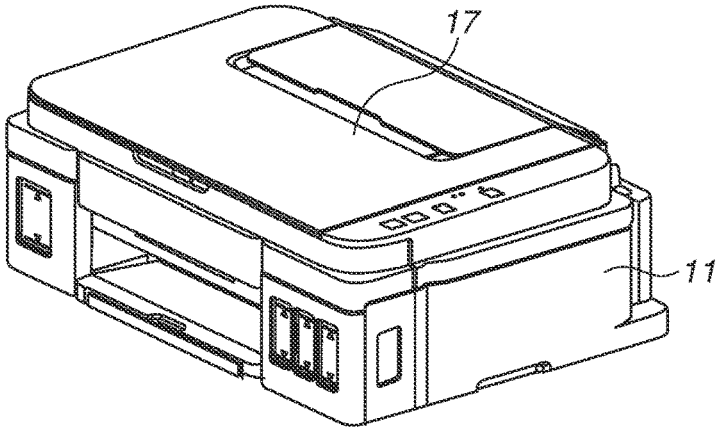
FIGS. 5A to 5C are diagrams illustrating ink injection operation to an ink tank according to the first exemplary embodiment.
Figure 5B:
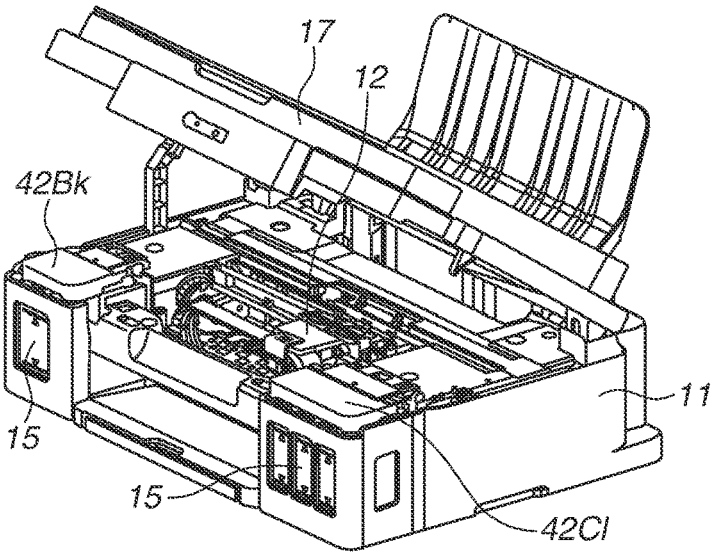
Figure 5C:
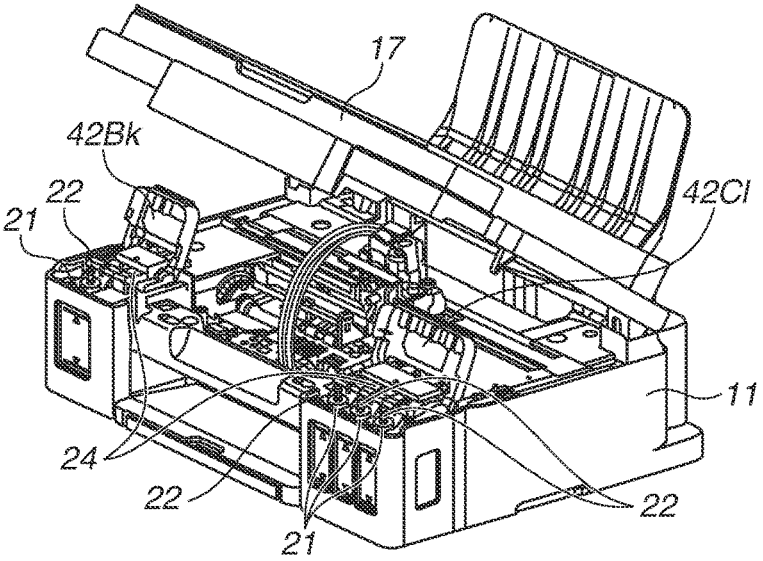

Next, ink injection operation by the user will be described with reference to FIGS. 5A to 5C. FIGS. 5A to 5C are perspective views of the recording apparatus 11. FIG. 5A illustrates a state where the scanner unit 17 is closed. When the user performs the ink injection operation, the user first lifts up the scanner unit 17 and attains the open state illustrated in FIG. 5B. A tank cover 42 that covers the filling port 21 and the like is provided below the scanner unit 17. A black tank cover 42Bk covers the filling port 21 of the black ink tank 151. A color tank cover 42C1 commonly covers the filling ports 21 of the cyan ink tank 152, the magenta ink tank 153, and the yellow ink tank 154. The black tank cover 42Bk and the color tank cover 42C1 are collectively referred to as the tank cover 42.

The tank cover 42 is pivotally supported by the main body of the recording apparatus 11, and is pivotally movable (movable), about a pivotal shaft, to a position (covering position) at which the tank cover 42 covers the filling port 21 and the cap 22 and to a position (exposure position) at which the filling port 21 and the cap 22 are exposed. When the user injects the ink, the user moves (opens) the tank cover 42 from the covering position to the exposure position. This allows the user to access the filling port 21 and the cap 22 as illustrated in FIG. 5C. Although the detail is described later, the operation of the tank cover 42 is interlocked with the operation of the valve unit 24. In other words, the valve unit 24 is closed and the ink supply path 14 and the atmosphere communication path 25 are occluded interlockingly with the opening operation of the tank cover 42 by the user.

In the state illustrated in FIG. 5C, the user removes the cap 22 attached to the filling port 21, and injects the ink of the unillustrated ink bottle from the filling port 21. After the ink injection operation is completed, the user again attaches the cap 22 to the filling port 21, and moves (closes) the tank cover 42 from the exposure position to the covering position. The valve unit 24 is changed from the closed state to the open state, and the ink supply path 14 and the atmosphere communication path 25 are opened interlockingly with the closing operation of the tank cover 42 by the user. Thereafter, the user closes and returns the scanner unit 17 to the state illustrated in FIG. 5A.

Figure 6A:
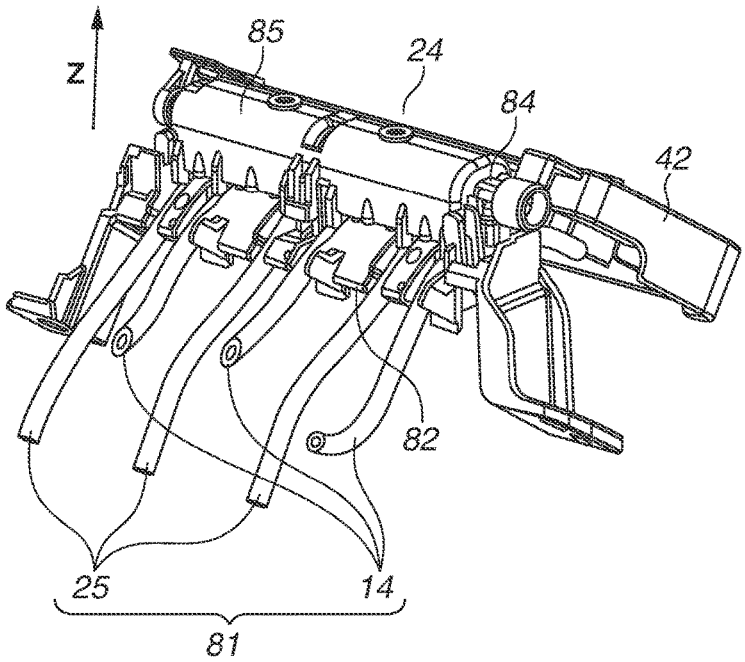
FIGS. 6A and 6B are perspective views each illustrating a configuration of a tank cover and a valve unit according to the first exemplary embodiment.
Figure 6B:
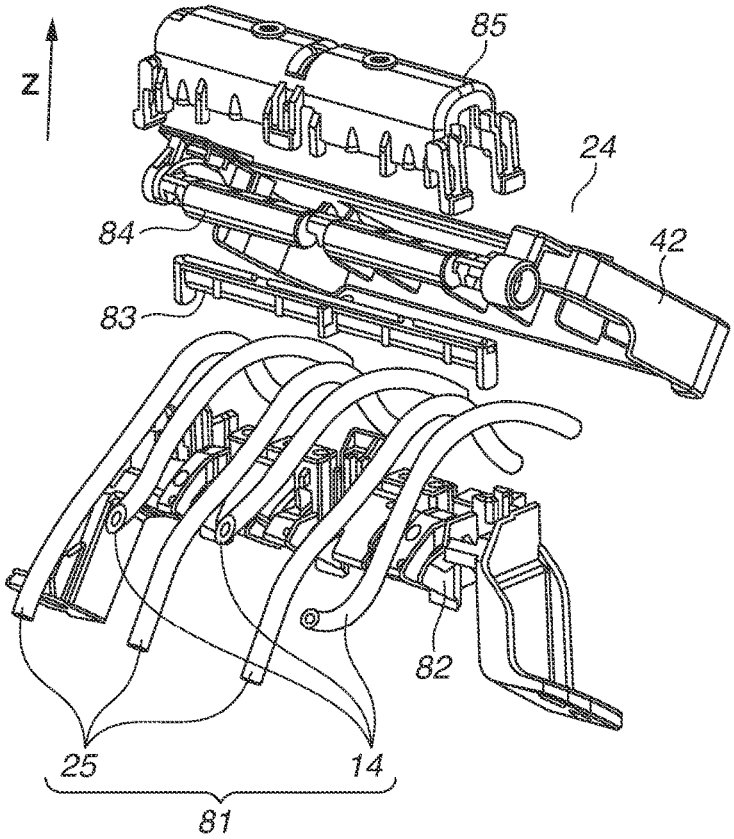

Next, a detailed configuration of the tank cover and the valve unit 24 is described with reference to FIGS. 6A and 6B. The valve unit 24 holds a tube unit 81 that configures the ink supply path 14 and the atmosphere communication path 25. The valve unit 24 includes a holding member 82 that holds the tube unit 81, and a displacement member 83 that is displaced in a vertical direction (Z direction) to crush and occlude the tube unit 81. Moreover, the valve unit 24 includes a cam member 84 and a cover member 85. The cam member 84 is pivotally supported and includes a cam surface that is rubbed against the displacement member 83. The cover member 85 supports the cam member 84 and is fixed to the holding member 82.

The occlusion operation of the ink supply path 14 and the atmosphere communication path 25 by the valve unit 24 will be described with reference to FIGS. 7A to 7C. For simplification, movement of the tank cover 42 will be described with use of a tank cover component 42*a* in FIGS. 7A to 7C. The tank cover component 42*a* is a component of the tank cover 42, and is integrally moved with movement of the tank cover 42.

Figure 7A:
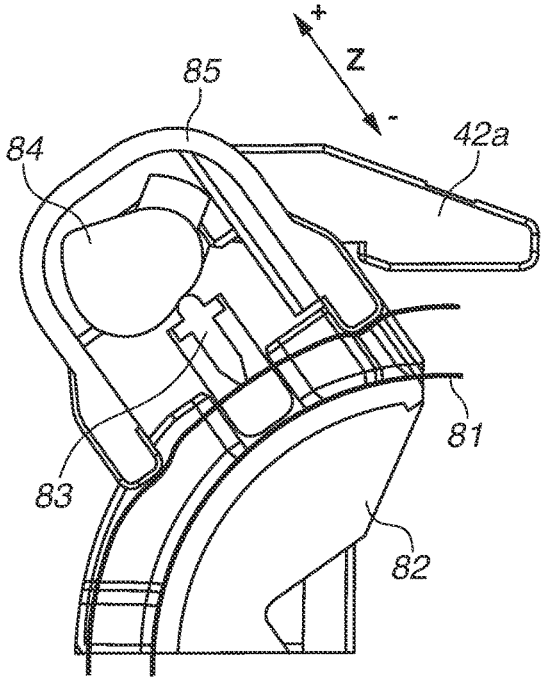
FIGS. 7A to 7C are schematic cross-sectional views each illustrating the configuration of the tank cover and the valve unit according to the first exemplary embodiment.
Figure 7C:
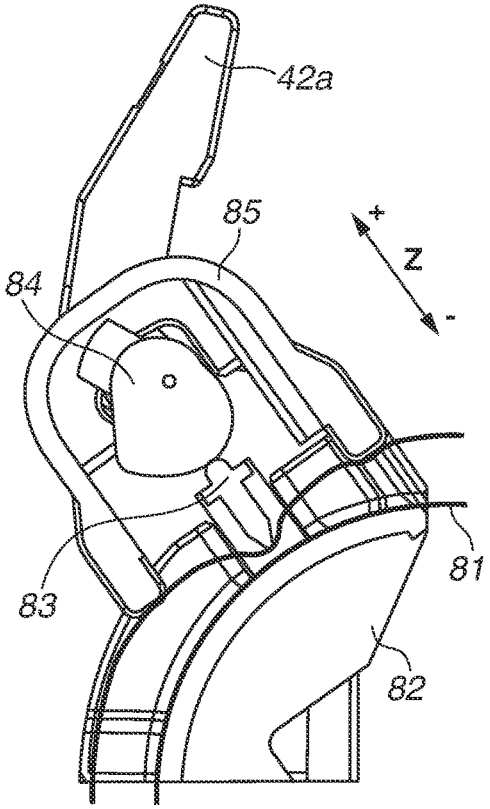

FIG. 7A illustrates the open state of the valve unit 24 in which the displacement member 83 does not crush the tube unit 81. At this time, the tank cover 42 is located at the covering position (FIG. 5B). Since the ink supply path 14 is opened, it is possible to supply the ink from the ink tank 15 to the recording head 13. The atmosphere communication path 25 is also opened, and the inside of the ink tank 15 and the atmosphere communicate with each other.

Figure 7B:
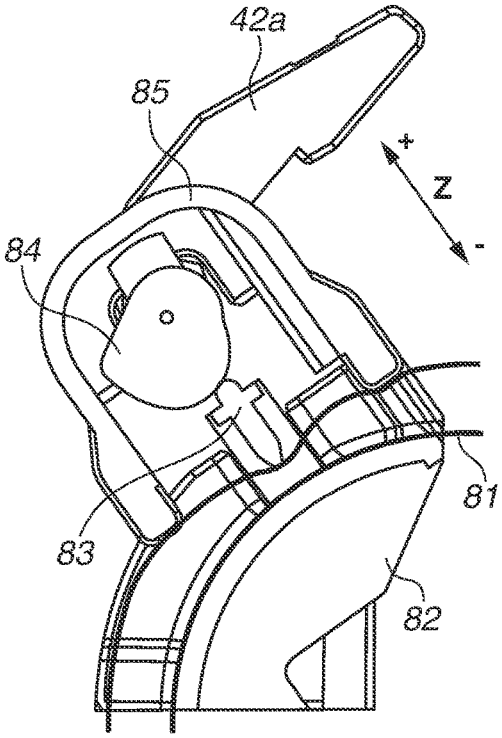

When the user opens the tank cover 42 to the exposure position, the cam member 84 rotates in a counterclockwise direction along with pivotal movement of the tank cover component 42*a* (see FIG. 7B). Further, as illustrated in FIGS. 7B and 7C, a convex part, relative to the rotation center, of the cam surface of the cam member 84 comes into contact with the displacement member 83. As a result, the displacement member 83 is displaced in −Z direction in FIGS. 7A to 7C to crush the tube unit 81. When the displacement member 83 is displaced up to a position illustrated in FIG. 7C, the valve unit 24 is put into the closed state and the tube unit 81 is crushed and occluded. At this time, the tank cover 42 is located at the exposure position (FIG. 5C). In the state illustrated in FIG. 7C, the ink supply path 14 is occluded, and the ink is not supplied from the ink tank 15 to the recording head 13. In addition, the inside of the ink tank 15 and the atmosphere do not communicate with each other because the atmosphere communication path 25 is also occluded.

With the above-described configuration, it is possible to easily open or close the ink supply path 14 and the atmosphere communication path 25 through the opening/closing operation of the tank cover 42 by the user. Accordingly, when the filling operation is performed by the user, the ink supply path 14 and the atmosphere communication path 25 are certainly occluded, which makes it possible to suppress leakage of the ink from the ink tank 15.

Figure 8A:
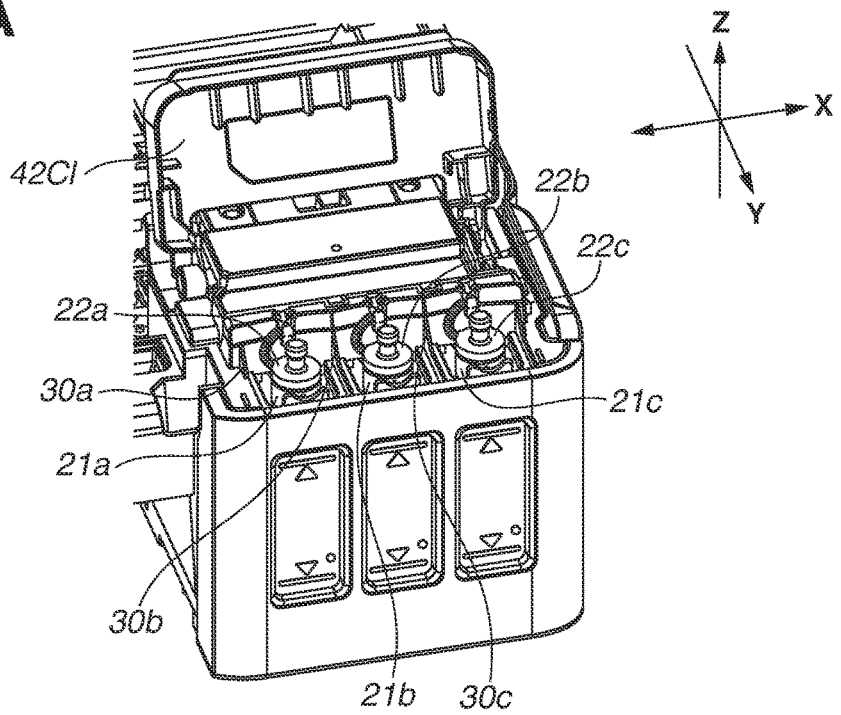
FIGS. 8A to 8C are diagrams each illustrating a cap and a peripheral configuration according to the first exemplary embodiment.

Next, the cap 22 and the peripheral configuration thereof will be described with reference to FIG. 8A to FIG. 10. In FIG. 8A to FIG. 10, the cap 22 of the color ink tank 15 is described as an example; however, the description is similarly applied to the black ink tank 151. FIG. 8A illustrates a state where the color tank cover 42C1 is located at the exposure position and the cap 22 is attached and closes the filling port 21. A position of the cap 22 illustrated in FIG. 8A is also referred to as a capping position because the filling port 21 is capped with the cap 22. As for the cyan ink tank 152, a cyan cap 22*a* is attached to a cyan filling port 21*a*. Likewise, as for the magenta ink tank 153, a magenta cap 22*b* is attached to a magenta filling port 21*b*, and as for the yellow ink tank 154, a yellow cap 22*c* is attached to a yellow filling port 21*c*.

A main body attachment part (hereinafter, attachment part) 223 is provided on the main body of the recording apparatus 11 on rear side of the filling port 21 (on upstream side in conveyance direction), and the cap 22 is attached to the attachment part 223, thereby being connected to the main body of the recording apparatus 11. Further, a rib (restricting part) 30 that extends forward (toward downstream side in conveyance direction) is provided on the attachment part 223 so as to be adjacent to the corresponding filling port 21. In FIG. 8A, a rib 30*a* is provided on left side of a cyan attachment part 223*a*, and a rib 30*b* is provided between the cyan attachment part 223*a* and a magenta attachment part 223*b*. Likewise, a rib 30*c* is provided between the magenta attachment part 223*b* and a yellow attachment part 223*c*. In other words, the rib 30*b* is provided between the cyan ink tank 152 and the magenta ink tank 153, and the rib 30*c* is provided between the magenta ink tank 153 and the yellow ink tank 154.

Figure 10:
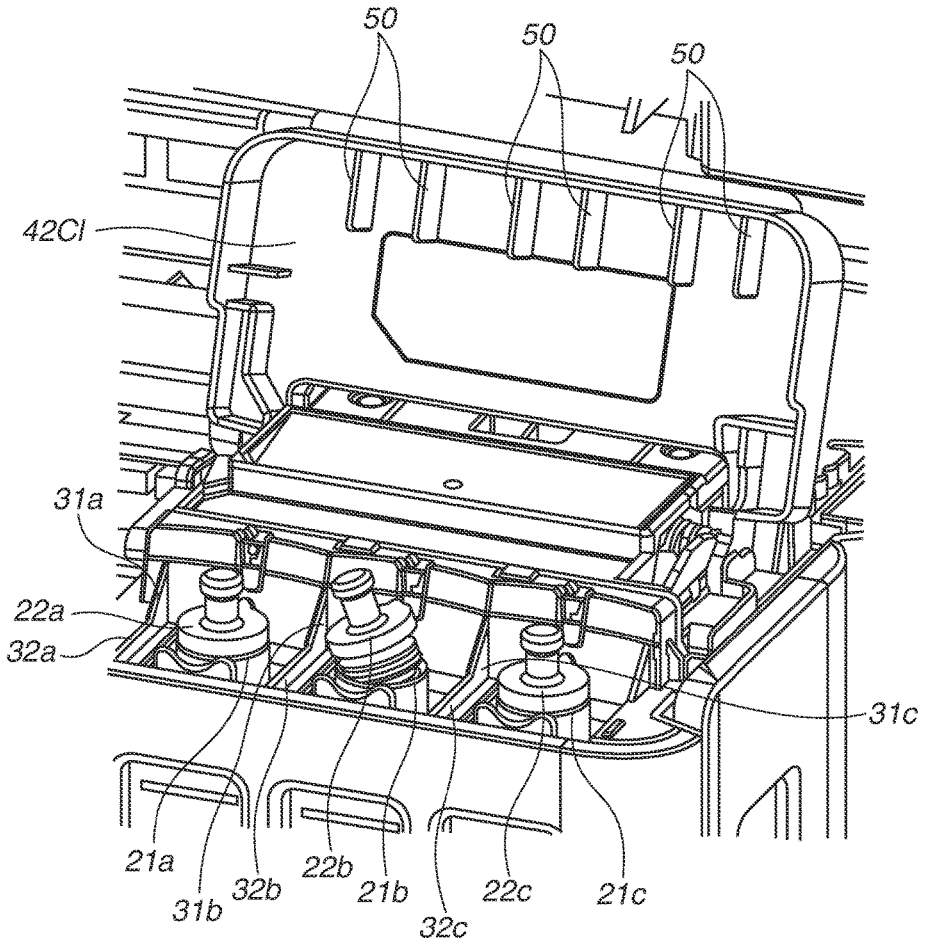
FIG. 10 is a diagram illustrating the configuration of the cap and the tank cover according to the first exemplary embodiment.

As illustrated in FIG. 10, each of the ribs 30 includes a first rib 31 (31*a*, 31*b*, or 31*c*) and a second rib (32*a*, 32*b*, or 32*c*). The first rib 31 configures an inclined surface in the vertical direction, and is provided such that a height thereof is gradually decreased from rear to front of the recording apparatus 11. A higher part of the inclined surface of the first rib 31 is connected to the attachment part 223, and a lower part of the inclined surface is connected to the second rib 32. The second rib has a height substantially equal to a height of the lower part of the first rib 31, and one end of the second rib 32 is connected to the first rib 31, and the other end extends toward the front of the recording apparatus 11.

Figure 8B:
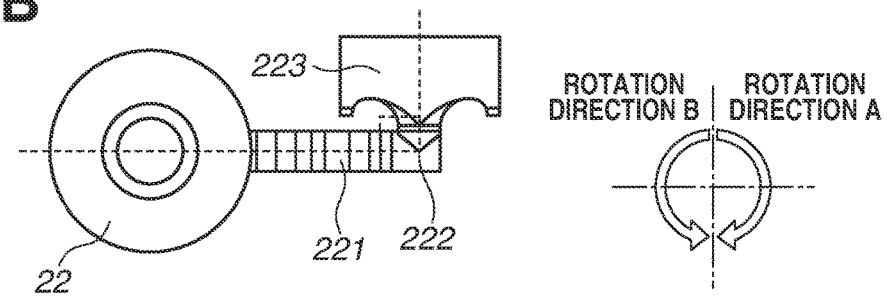

FIG. 8B is a top view illustrating the detailed configuration of the cap 22. The cap 22 is connected to the attachment part 223 through a lead part 221 including an elastic member or the like. The lead part 221 includes a bent part 222 that is bent by approximately 90 degrees in a rotation direction A illustrated in FIG. 8B, near the attachment part 223. Accordingly, the lead part 221 and the bent part 222 serve as a connection portion that connects the cap 22 and the attachment part 223. In a natural state with no member coming into contact with or holding the cap 22, the state of the cap 22 illustrated in FIG. 8B is maintained by the bent part 222. In other words, the cap 22 is biased in a direction separating from the filling port 21 by the bent part 222. In the first exemplary embodiment, the cap 22, the lead part 221, and the bent part 222 are all integrally formed.

Figure 8C:
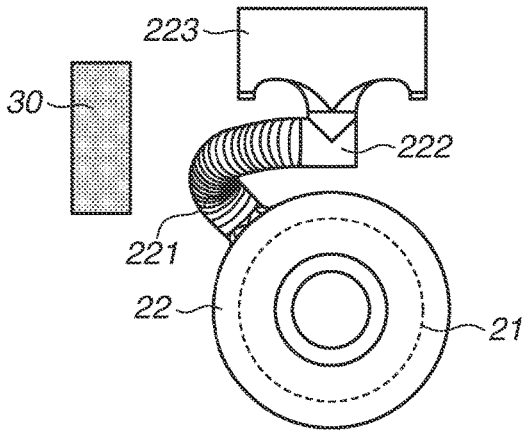

When the cap 22 closes the filling port 21 as illustrated in FIG. 8A, the lead part 221 is curved in a rotation direction B to a state illustrated in FIG. 8C. In FIG. 8C, the filling port 21 is illustrated by a dashed line. At this time, the lead part 221 is curved in a direction opposite to a bent direction of the bent part 222, thereby generating restoring force (elastic force) in the lead part 221 which causes the lead part 221 to return to the rotation direction A. Friction force derived from attaching and holding of the cap 22 on the filling port 21, however, is larger than the elastic force of the lead part 221. Therefore, the cap 22 is held at the capping position to close the filling port 21. Accordingly, when the cap 22 is attached to the filling port 21, the cap 22 and the lead part 221 are both not in contact with the rib 30.

Figure 9A:
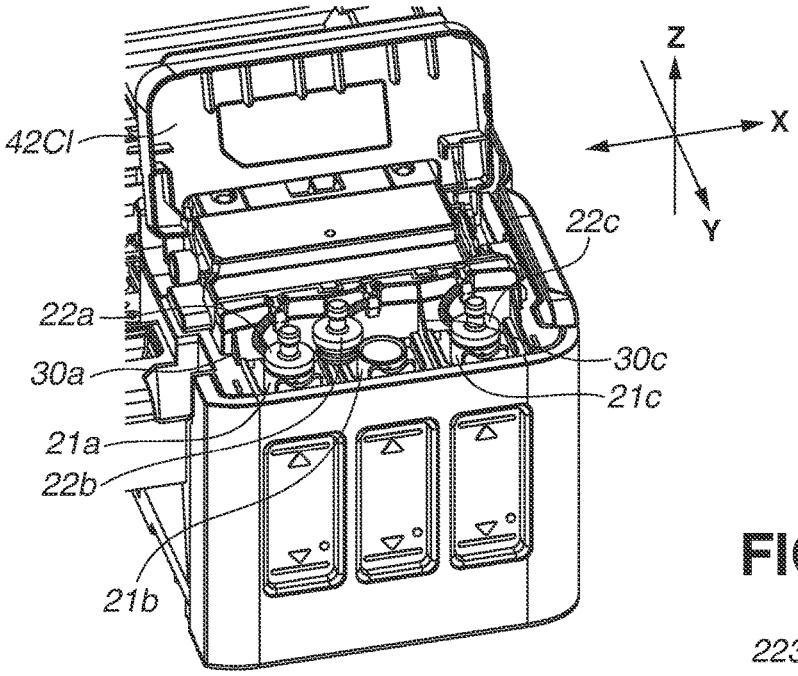
FIGS. 9A to 9C are diagrams each illustrating the cap and the peripheral configuration according to the first exemplary embodiment.
Figure 9B:
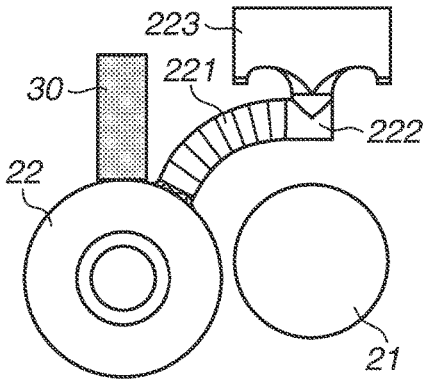

FIG. 9A illustrates a state where the color tank cover 42C1 is located at the exposure position, and the magenta cap 22*b* is removed from the magenta filling port 21*b* and the magenta filling port 21*b* is opened. As illustrated in FIG. 9B, when the cap 22 is removed from the filling port 21 by the user, the cap 22 is biased in the rotation direction A by the elastic force of the lead part 221. When the cap 22 is biased, the lead part 221 is pivotally moved in the rotation direction A around the bent part 222, and the biased cap 222 comes into contact with the rib 30, thereby being restricted in the pivotal movement. As described above, when the cap 22 is removed from the filling port 21 by the user, the cap 22 is moved, by the elastic force of the lead part 221, from the capping position at which the cap 22 closes the filling port 21 to a retracted position at which the filling port 21 is opened.

Figure 9C:
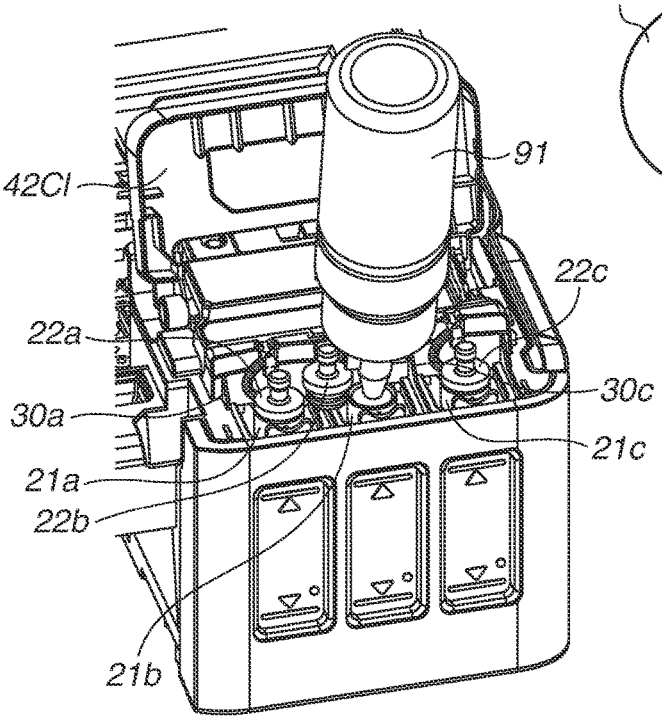

As a result, as illustrated in FIG. 9C, it is possible for the user to easily perform ink injection operation when the user injects the ink of the ink bottle 91 into the ink tank 15. In other words, removal operation of the cap 22 by the user makes it possible to maintain the state where the cap 22 is located at the retracted position at which the filling port 21 is opened. The cap 22 is located at the retracted position not only in a case where the entire filling port 21 is opened but also in a case where a part of the filling port 21 is opened. Further, the pivotal movement of the lead part 221 is restricted by the rib 30, which reduces contamination of the adjacent filling port 21 and the cap 22 by the ink. More specifically, the magenta cap 22*b* comes into contact with the rib 30*b* as illustrated in FIG. 9A, which reduces adhesion of the magenta ink to the cyan cap 22*a* and the cyan filling port 21*a*. This suppresses color mixing of the ink.

The cap 22 moved to the retracted position may come into contact with any of the first rib 31 and the second rib 32 of the rib 30. The cap 22 may come into contact with different positions of the rib 30 due to deviation of the removal direction of the cap 22 by the user or variation in component dimensions of the lead part 221 and the bent part 222. In other words, the retracted position of the cap 22 is not limited to one position, and is defined as a position at which the cap 22 is removed from the filling port 21 to open the filling port 21. Moreover, a bent angle of the bent part 222 is not limited to 90 degrees, and may be set to other values. Furthermore, the attachment part 223 may be provided on the ink tank 15 without limitation to being provided on the main body of the recording apparatus 11.

As described above, the simple configuration in which the cap 22 is moved from the capping position to the retracted position with use of the restoring force of the lead part 221 makes it possible to facilitate the ink injection operation by the user. In other words, it is possible for the user to open the filling port 21 by one action of removal of the cap 22 from the filling port 21, and the cap 22 is not lost because the cap 22 is connected to the main body of the recording apparatus 11 through the lead part 221 and the like. In addition, the cap 22 moved to the retracted position is brought into contact with the rib 30, which restricts the movement range of the cap 22. This reduces adhesion of the ink to the other portions of the recording apparatus 11 due to movement of the cap 22.

In the first exemplary embodiment, the cap 22, the lead part 221, and the bent part 222 are configured as one component; however, the present disclosure is not limited thereto. The cap 22 may be biased toward the retracted position with use of a member such as a spring, and the user may apply force against the biasing force to attach the cap 22 to the filling port 21.

Next, a configuration to prevent forgetting to close the cap 22 is described with reference to FIG. 10 and FIGS. 11A and 11B. As illustrated in FIG. 10, a plurality of cover ribs 50 are provided on an inner surface (surface to face filling port 21 at covering position) of the tank cover 42. Two cover ribs 50 are provided for one filling port 21. In FIG. 10, the magenta cap 22*b* is not correctly attached to the magenta filling port 21*b* and is not positioned at the correct capping position.

Figure 11A:
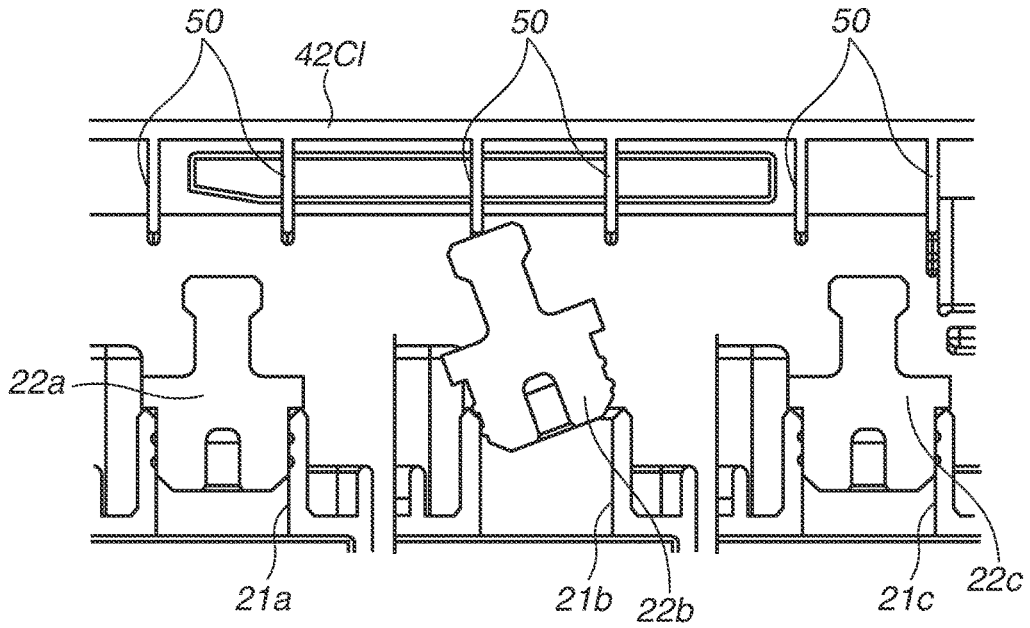
FIGS. 11A and 11B are diagrams each illustrating the configuration of the cap and the tank cover according to the first exemplary embodiment.

If the user attempts to move the tank cover 42 from the exposure position to the covering position in the state illustrated in FIG. 10, the magenta cap 22*b* and the cover rib 50 come into contact with each other as illustrated in FIG. 11A, and thus the tank cover 42 is not closed to the covering position. In the state where the cap 22 is not positioned at the capping position, pivotal movement of the tank cover 42 is restricted by the cover ribs 50 and the cap 22*b*. In other words, the pivotal movement of the tank cover 42 to the covering position is restricted also in the state where the cap 22 is located at the retracted position. As described above, the user cannot close the tank cover 42 to the covering position in the case where the cap 22 is not correctly attached.

Figure 11B:
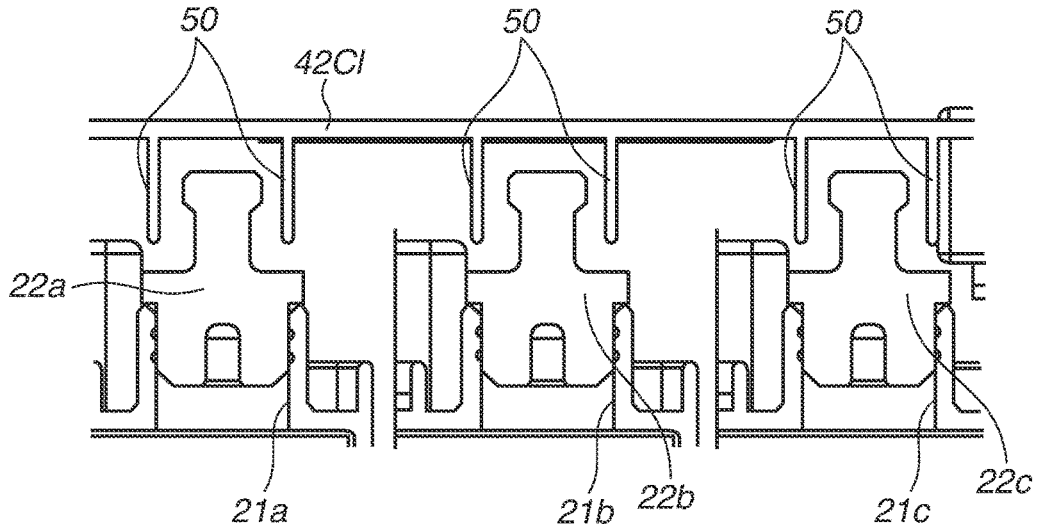

In contrast, in a case where all of the caps 22 are respectively correctly attached to the filling ports 21 and are positioned at the capping positions as illustrated in FIG. 11B, the movement of the tank cover 42 to the covering position is not restricted, and the user can close the tank cover 42 to the covering position. This is because the cap 22 is housed between the two cover ribs 50, and is not in contact with any of the cover ribs 50 in this case.

Providing the cover ribs 50 described above makes it possible to prevent the user from using the recording apparatus 11 when the user forgets to attach the cap 22 to the filling port 21. This makes it possible to suppress variation of the ink head difference between the ink tank 15 and the recording head 13 due to the user forgetting to attach the cap 22 and to accordingly prevent leakage of the ink.

Figure 12A:
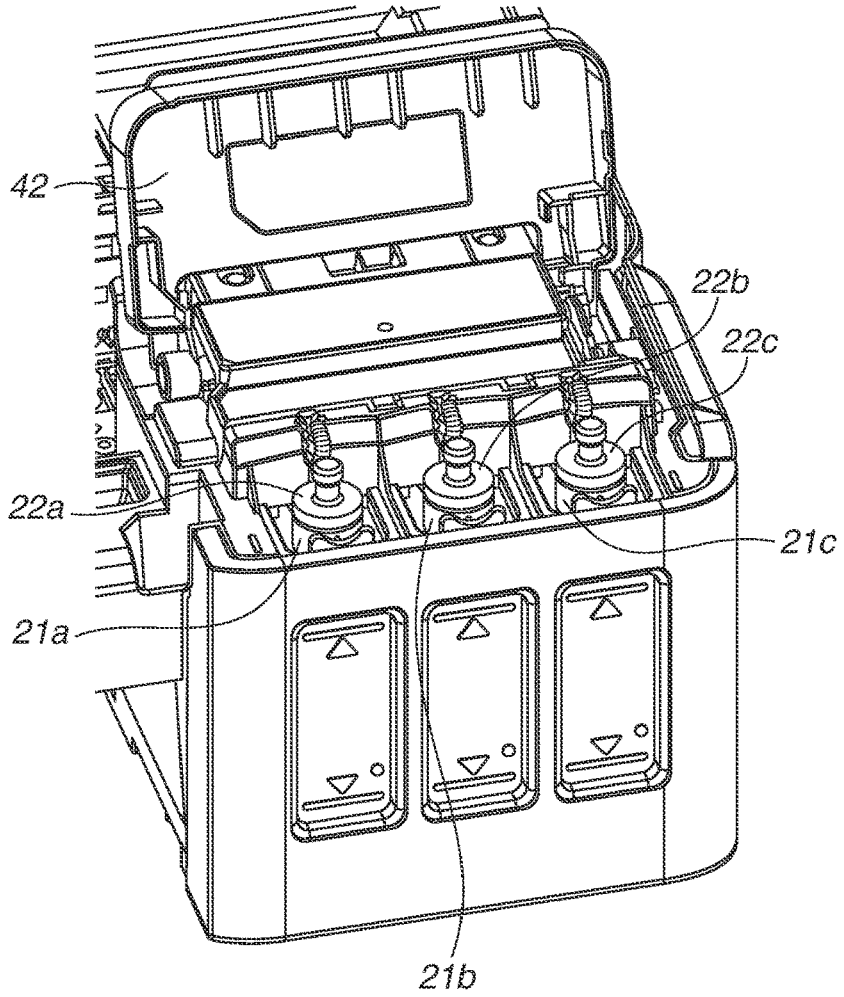
FIGS. 12A and 12B are diagrams each illustrating a cap and a peripheral configuration according to a second exemplary embodiment.

A cap 22 according to a second exemplary embodiment will be described with reference to FIG. 12A to FIG. 13C. The cap 22 of the color ink tank 15 is described as an example in FIG. 12A to FIG. 13C; however, the description is similarly applied to the black ink tank 151. In FIG. 12A, the color tank cover 42C1 is located at the exposure position, and the cap 22 corresponding to each of the colors is located at the capping position.

Figure 12B:
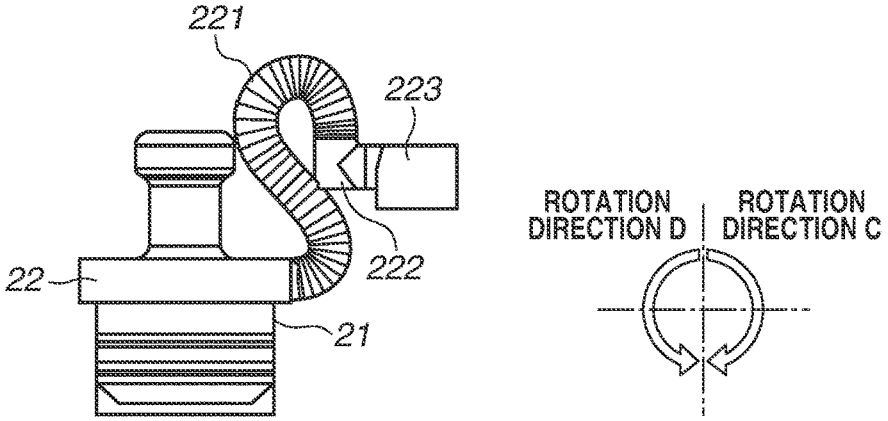

FIG. 12B is a top view illustrating a detailed configuration of the cap 22 according to the second exemplary embodiment. The cap 22 is attached to the attachment part 223 through the lead part 221 as in the case with the first exemplary embodiment. In the second exemplary embodiment, the bent part 222 of the lead part 221 is bent by approximately 90 degrees in a rotation direction C with respect to the attachment part 223. Accordingly, the lead part 221 is curved in a rotation direction D at the capping position at which the cap 22 is attached to the filling port 21. The lead part 221 is curved in a direction opposite to the bent direction of the bent part 222, thereby generating restoring force (elastic force) in the lead part 221 which causes the lead part 221 to return to the rotation direction C. Friction force derived from attaching and holding of the cap 22 on the filling port 21, however, is larger than the elastic force of the lead part 221. Therefore, the cap 22 is held at the capping position to close the filling port 21.

Figure 13A:
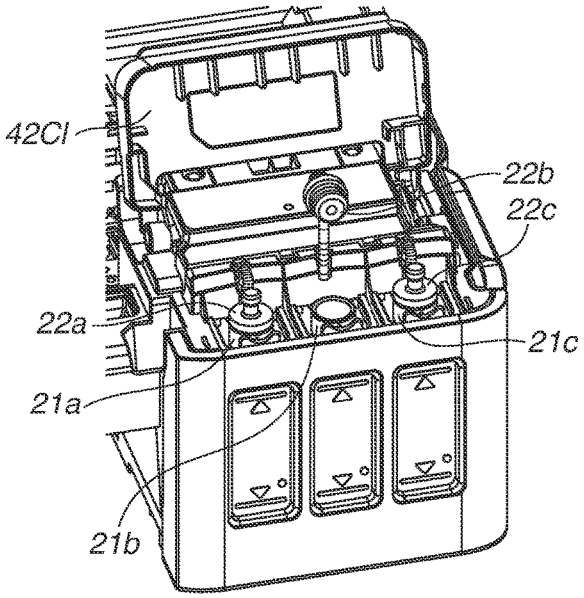
FIGS. 13A to 13C are diagrams each illustrating the cap and the peripheral configuration according to the second exemplary embodiment.
Figure 13B:
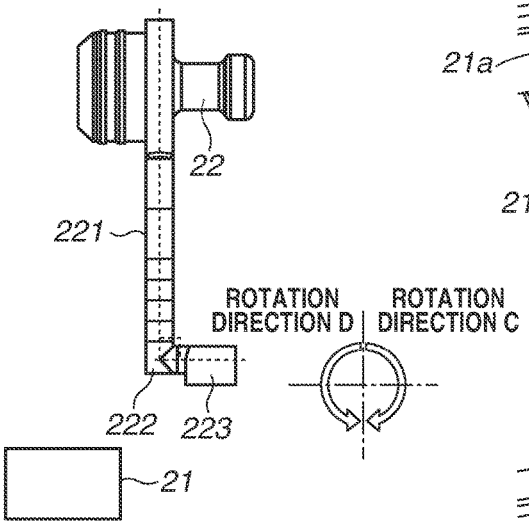
Figure 13C:
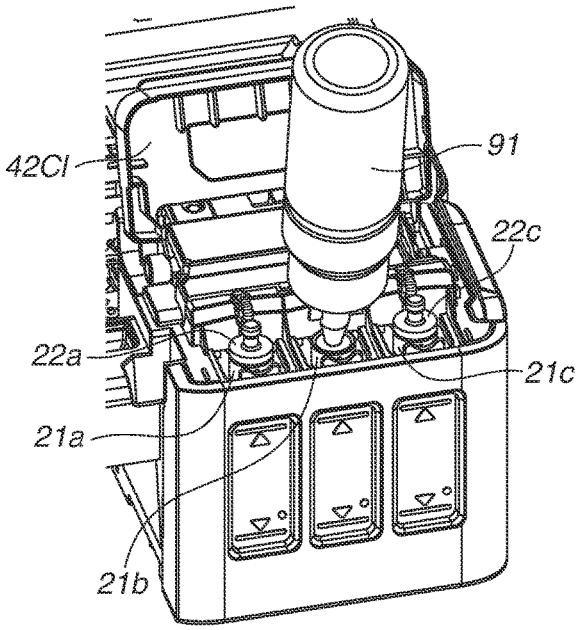

FIG. 13A illustrates a state where the color tank cover 42C1 is located at the exposure position, and the magenta cap 22*b* is removed from the magenta filling port 21*b* and the magenta filling port 21*b* is opened. As illustrated in FIG. 13B, when the cap 22 is removed from the filling port 21 by the user, the cap 22 is moved from the capping position to the retracted position by the elastic force of the lead part 221. The retracted position of the cap 22 in the second exemplary embodiment is a position vertically above the filling port 21. Therefore, as illustrated in FIG. 13C, insertion of the ink bottle 91 into the filling port 21 is not interfered also in the second exemplary embodiment, which allows the user to easily perform the ink injection operation. A rib that comes into contact with the lead part 221 biased upward or the cap 22 for restricting the movement of the cap 22, may be provided.

The present disclosure makes it possible to provide the inkjet recording apparatus that allows for easy injection of the ink.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-088488, filed Apr. 27, 2017, which is hereby incorporated by reference herein in its entirety.

What is claimed is:

1. An inkjet recording apparatus, comprising:

a recording head configured to eject ink to record an image;

a first tank including a filling port for injection of first ink, and configured to contain the ink to be supplied to the recording head;

a cap configured to close the filling port;

a rib provided between the first tank and the second tank; and an elastic connection portion configured to connect the cap to the first tank or a main body of the apparatus, and to bias the cap in a direction separating from the filling port to the rib, wherein the rib restricts the movement of the cap biased by the elastic connection portion.

2. The inkjet recording apparatus according to claim 1, further comprising:

a cover configured to be movable to an exposure position at which the cap is exposed and a covering position at which the cover covers the cap, the cover being restricted in movement from the exposure position to the covering position when the cap is removed from the filling port.

3. The inkjet recording apparatus according to claim 2, wherein the cover includes a cover rib on an inner surface that faces a surface provided with the filling port of the first tank at the covering position.

4. The inkjet recording apparatus according to claim 2, further comprising:

an ink flow path configured to connect the recording head and the first tank to each other; and a valve configured to perform switching between an open state in which the first ink is supplied from the first tank to the recording head through the ink flow path and a closed state in which the supply of the first ink from the first tank to the recording head through the ink flow path is blocked, wherein the valve is in the open state when the cover is located at the covering position, and the valve is in the closed state when the cover is located at the exposure position.

5. The inkjet recording apparatus according to claim 1, further comprising:

a black tank configured to contain black ink to be supplied to the recording head; and a discharging unit configured to discharge a recording medium on which an image has been recorded by the recording head, wherein the first ink is color ink, and the discharging unit is provided between the black tank and the first tank.

6. An inkjet recording apparatus, comprising:

a recording head configured to eject ink to record an image;

a first tank including a filling port for injection of first ink, and configured to contain the first ink to be supplied to the recording head;

a second tank provided adjacently to the first tank and configured to contain a second ink to be supplied to the recording head;

a cap configured to close the filling port;

an elastic connection portion configured to connect the cap to the first tank or a main body of the apparatus, and to bias the cap in a direction separating from the filling port to the second tank; and a rib provided between the first tank and the second tank and configured to restrict movement of the cap biased by the connection portion.

7. The inkjet recording apparatus according to claim 6, further comprising:

a cover configured to be movable to an exposure position at which the cap is exposed and a covering position at which the cover covers the cap, the cover being restricted in movement from the exposure position to the covering position when the cap is removed from the filling port.

8. The inkjet recording apparatus according to claim 7, wherein the cover includes a cover rib on an inner surface that faces a surface provided with the filling port of the ink tank at the covering position.

9. The inkjet recording apparatus according to claim 7, further comprising:

an ink flow path configured to connect the recording head and the ink tank to each other; and a valve configured to perform switching between an open state in which the ink is supplied from the ink tank to the recording head through the ink flow path and a closed state in which the supply of the ink from the ink tank to the recording head through the ink flow path is blocked, wherein the valve is in the open state when the cover is located at the covering position, and the valve is in the closed state when the cover is located at the exposure position.

* * * * *